US008931563B2

(12) United States Patent
Holtet et al.

(10) Patent No.: US 8,931,563 B2
(45) Date of Patent: Jan. 13, 2015

(54) AUXILIARY SUBSURFACE COMPENSATOR

(75) Inventors: Ole Jorgen Holtet, Oslo (NO); Linn Therese Thuv, Oslo (NO); Simen Ronne, Kongsberg (NO)

(73) Assignee: Aker Subsea AS, Lysaker (NO)

( * ) Notice: Subject to any disclaimer, the term of this patent is extended or adjusted under 35 U.S.C. 154(b) by 665 days.

(21) Appl. No.: 13/142,891

(22) PCT Filed: Dec. 23, 2009

(86) PCT No.: PCT/EP2009/067868
§ 371 (c)(1),
(2), (4) Date: Jun. 30, 2011

(87) PCT Pub. No.: WO2010/079099
PCT Pub. Date: Jul. 15, 2010

(65) Prior Publication Data

US 2011/0308809 A1 Dec. 22, 2011

(30) Foreign Application Priority Data

Jan. 8, 2009 (NO) ..... 20090083

(51) Int. Cl.
*E21B 7/12* (2006.01)
*E21B 17/07* (2006.01)
(Continued)

(52) U.S. Cl.
CPC ..... *E21B 17/07* (2013.01); *E21B 17/021* (2013.01); *E21B 17/06* (2013.01)
USPC ..... 166/360; 166/367; 166/368

(58) Field of Classification Search
USPC ..... 166/338, 344, 347, 351, 368, 85.1
See application file for complete search history.

(56) References Cited

U.S. PATENT DOCUMENTS 3,643,751 A 2/1972 Crickmer
4,055,338 A * 10/1977 Dyer ..... 267/125
4,192,155 A * 3/1980 Gray ..... 464/20
(Continued)

FOREIGN PATENT DOCUMENTS

EA 200500750 12/2005
SU 929804 A1 5/1982
WO WO-2004/044374 A1 5/2004

OTHER PUBLICATIONS

Schouten, Adri, "International Search Report", for PCT/EP2009/067868, as mailed Aug. 18, 2010, 3 pages.

*Primary Examiner* — Matthew Buck
*Assistant Examiner* — Aaron Lembo
(74) *Attorney, Agent, or Firm* — Winstead PC

(57) ABSTRACT

Force-dampening arrangement (100) for dampening forces between two interconnectable parts in a tube string, of which interconnectable parts a lower part (101) is connected to the upper end of a string element (105, 3*a*) extending into a subsea well (5) and an upper part (103) is suspended from a floating surface installation (1) through at least one suspension element (3*b*) extending up to said surface installation. The force-dampening arrangement (100) is connected to the tube string above a string-portion (3*a*) extending into said subsea well, and below at least a portion of said suspension element (3*b*). The force dampening arrangement (100) exhibits an upper and lower section (109, 111) that are vertically movable in relation to each other, thereby yielding for impact forces between said interconnectable upper and lower parts (103, 101) resulting from vertical heave movement of said portion of suspension elements (3*b*) moving vertically in respect of the string element (3*a*).

19 Claims, 5 Drawing Sheets

(51) Int. Cl.
*E21B 17/02* (2006.01)
*E21B 17/06* (2006.01)

(56) References Cited

U.S. PATENT DOCUMENTS

| | | | | | |
|---|---|---|---|---|---|
| 4,257,245 | A * | 3/1981 | Toelke et al. | 464/20 |
| 4,398,898 | A * | 8/1983 | Odom | 464/20 |
| 4,466,487 | A * | 8/1984 | Taylor, Jr. | 166/339 |
| 4,502,552 | A * | 3/1985 | Martini | 175/56 |
| 4,552,230 | A * | 11/1985 | Anderson et al. | 175/321 |
| 4,554,976 | A * | 11/1985 | Hynes et al. | 166/341 |
| 4,617,998 | A | 10/1986 | Langner | |
| 4,702,320 | A * | 10/1987 | Gano et al. | 166/343 |
| 4,759,738 | A * | 7/1988 | Johnson | 464/20 |
| 4,844,181 | A | 7/1989 | Bassinger | |
| 5,105,890 | A * | 4/1992 | Duguid et al. | 166/380 |
| 5,133,419 | A * | 7/1992 | Barrington | 175/321 |
| 5,224,898 | A * | 7/1993 | Johnson et al. | 464/20 |
| 5,996,712 | A * | 12/1999 | Boyd | 175/321 |
| 6,332,841 | B1 * | 12/2001 | Secord | 464/20 |
| 6,412,614 | B1 * | 7/2002 | Lagrange et al. | 188/281 |
| 7,225,877 | B2 * | 6/2007 | Yater | 166/344 |
| 7,311,148 | B2 * | 12/2007 | Giroux et al. | 166/285 |
| 7,377,338 | B2 * | 5/2008 | Bassinger | 175/296 |
| 7,392,850 | B2 * | 7/2008 | Boyd | 166/385 |
| 7,413,023 | B2 * | 8/2008 | Howlett | 166/387 |
| 7,779,932 | B2 * | 8/2010 | Hartung et al. | 175/56 |
| 7,854,264 | B2 * | 12/2010 | Mandrou et al. | 166/344 |
| 8,066,075 | B2 * | 11/2011 | Cowie et al. | 166/344 |
| 8,100,185 | B2 * | 1/2012 | McGuire et al. | 166/379 |
| 8,118,088 | B2 * | 2/2012 | Wright et al. | 166/54.5 |
| 8,240,371 | B2 * | 8/2012 | Tepavac et al. | 166/77.51 |
| 8,281,863 | B2 * | 10/2012 | Voss | 166/351 |
| 8,281,877 | B2 * | 10/2012 | Shahin et al. | 175/162 |
| 8,323,115 | B2 * | 12/2012 | Hocking | 464/20 |
| 8,387,707 | B2 * | 3/2013 | Adamek et al. | 166/367 |
| 8,567,512 | B2 * | 10/2013 | Odell et al. | 166/379 |
| 8,579,033 | B1 * | 11/2013 | Robichaux et al. | 166/351 |
| 8,590,634 | B2 * | 11/2013 | Bamford | 175/5 |
| 2005/0284639 | A1 * | 12/2005 | Reimert | 166/363 |
| 2006/0102387 | A1 * | 5/2006 | Bourgoyne et al. | 175/5 |
| 2007/0169930 | A1 * | 7/2007 | Shahin et al. | 166/77.52 |
| 2007/0272415 | A1 * | 11/2007 | Ratliff et al. | 166/368 |
| 2010/0319931 | A1 * | 12/2010 | Alff et al. | 166/378 |
| 2012/0000664 | A1 * | 1/2012 | Nas et al. | 166/344 |
| 2013/0206386 | A1 * | 8/2013 | Bailey et al. | 166/66 |

* cited by examiner

AUXILIARY SUBSURFACE COMPENSATOR

The present invention relates to an arrangement for non-harmful coupling and decoupling to pipe strings in a subsurface position from a surface installation. More particularly, the invention relates to an arrangement for preventing harmful impacts due to vertical movements caused by heave movements of the surface installation during connection or disconnection in a subsurface position.

BACKGROUND

It is known to provide offshore surface installations, such as drilling rigs used in connection with subsea well operations, with heave compensators. A heave compensator is arranged in the interface between a pipe string extending down to the sea floor and the surface installation. When the surface installation is moved vertically due to waves and swells, the heave compensator ensures that the vertical movement of the installation is not transferred to the pipe string, keeping the pipe string vertically still with regard to the sea floor. However, if the pipe string is disconnected from a sea floor facility, such as a subsea well installation, the pipe string will exhibit some vertical movements despite the heave compensator. For instance, with vertical heave movements of the surface installation in the order of 7 meters, the pipe string will perhaps move vertically up and down a distance in the order of about 30 cm.

Due to the heave compensator, the surface installation can keep operating even in quite rough sea with waves being several meters high. However, if the conditions become too extreme, operation must be halted and the surface installation must be disconnected from the pipe string extending into the well.

For instance, when drilling a subsea well from a floating drilling rig, the drill pipe can extend several thousands of meters down into the well. In order to disconnect the drill pipe from the drilling rig, the drill pipe is hung off at the top of the well. To do this, the drill pipe is first pulled up to the drilling rig with a distance approximately corresponding to the sea depth. Then a hang-off tool is connected to the drill pipe below it and lowered down to the top of the well on a drill pipe connected to the upper part of the tool. With the hang-off tool, the drill pipe is hung off at the top of the well, for instance in the well head, the tree, or bore protector, while extending into the drilled well. The hang-off tool is then disconnected from the drill pipe above it, on which it was lowered, thus becoming disconnected from the drilling rig.

When surface conditions have returned to operating conditions, the drilling rig can again be connected to the hang-off tool. A suspension element, such as a drill pipe, is lowered down from the installation and connects to the hang-off tool. The hang-off tool is then pulled up to the rig and removed. Then drill pipe is again extended and lowered, and operations can be resumed.

When disconnecting the hang-off tool from the suspension element, such as the pipe string above it, the suspension element will exhibit some vertical movement despite the heave compensator at the drilling rig if considerable waves affect the rig. Thus, soon after disconnection, the pipe string can move down and collide with the part from which it was disconnected. Due to the weight of the suspension elements this can cause substantial damage to both connection interfaces. That is, both the lower and upper part of the mating connection parts can be damaged. The same problem arises when the parts are to be reconnected. As the upper part closes in on the lower part when being lowered from the surface, it can in addition to the intentional lowering exhibit reciprocating vertical movements. Before the upper connection part is properly connected to the lower part, the connection interface may thus be damaged.

Conventional means of connection are threads. Thus, when connecting or disconnecting, the upper connection part is rotated as it is lowered onto or pulled upwardly from the lower part. The outermost threads are therefore often damaged. An obvious means to overcome this problem would be to use larger threads that tolerate larger impacts. Larger threads would however imply larger thread pitch, which may increase the risk of the connection unscrewing itself. Furthermore, even larger threads could be damaged severely enough to cause problems when connecting or disconnecting. In any case, the vertical heave movements will cause undesirable tear and wear.

Also other means for releasable connection may be used. However, regardless of which type of connection being used, a downwardly moving suspension element in the form of a string of pipe represents substantial forces that in any case are desirable to reduce.

Thus, the object of the present invention is to provide a solution to the above-mentioned problem of damage to the connection interface when disconnecting and reconnecting.

THE INVENTION

According to the present invention, there is provided a force-dampening arrangement for dampening forces between two interconnectable parts in a tube string, of which a lower part is connected to the upper end of a string element extending into a subsea well and an upper part is suspended from a floating surface installation through at least one suspension element extending up to said surface installation. The string element can by any kind of string element extending into a subsea well, such as a string of wire, drill pipe, or coiled tubing. According to the invention, the force-dampening arrangement is connected to the tube string above a string-portion extending into said subsea well, and below at least a portion of said suspension element. Moreover, the force dampening arrangement exhibits an upper and lower section that are vertically movable in relation to each other, thereby yielding for impact forces between said interconnectable upper and lower parts resulting from vertical heave movement of said portion of suspension elements moving vertically in respect of the string element.

The term vertically shall not be interpreted as a direction strictly normal to the horizontal. Instead, it shall be construed as the general direction of the string element or suspension element at the place of the force-dampening arrangement. This direction will in general be substantially vertical. However, one can also imagine an inclination for this direction, with respect to the strict vertical direction.

In an embodiment of the invention, the upper and lower section are rotationally interconnected in such manner that rotation of one section will instantly or eventually result in rotation of or rotational forces exerted onto the other section. Thus, a rotational force applied to a string of drill pipe, for instance, from the floating surface installation, will be transmitted through the force-dampening arrangement down to lower sections of the drill pipe, arranged below the force-dampening arrangement.

In a further embodiment, the said suspension element comprises a drill string. Thus, in a practical use of the force-dampening arrangement, it is used when a drill string is to be hung of in a subsea well. In such a case, the drill string is raised a distance approximately corresponding to the sea depth, then a hang-off tool is arranged to the remaining drill string. To the hang-off tool, or preferably at least close to it, the force-dampening arrangement is then connected. Thereafter, the assembly is lowered on the said drill sting, the drill string then being the suspension element.

When in a disconnected mode of said interconnectable parts, the string element is preferably suspended with a hang-off tool.

In one embodiment, the two interconnectable parts exhibit a threaded connection. Thus, when connecting or disconnecting said interconnectable parts at a distance below the floating surface installation, such as at the subsea well, the force-dampening arrangement will protect the outermost threads from damaging heave movements.

Preferably, one of said sections exhibits a compartment within which a portion of the other section can reciprocate in a vertical direction. This feature makes it possible to provide a dampening function. In one embodiment, the other section extends into said compartment with a non-concentric through part running through a non-concentric opening in the compartment-exhibiting section, whereby a rotational movement of a first section will result in rotational forces onto the second section. This is one way of providing transmission of rotational forces.

Furthermore, the that said other section can exhibit a piston component arranged in said compartment, which compartment is shaped as a piston cylinder, and a seal can be arranged to seal between said piston cylinder and the piston component.

In a particularly preferred embodiment, the force-dampening arrangement comprises one or a plurality of vents for the inflow or outflow of surrounding water into or out of, respectively, said compartment, said vent(s) functioning as damper for the relative movements between said two sections.

One of said interconnectable parts can be integrated with one of said sections. In this way the force-dampening function will be oriented near to the interconnection interface, advantageously resulting in a small mass between said interface and the force-dampening arrangement.

In one embodiment of the present invention, the force-dampening assembly further comprises a spring that is functionally arranged between said two sections to dampen the mutually vertical movement.

Preferably, for the force-dampening arrangement according to the present invention to function well, it should be arranged near the two interconnectable parts or their interface. Thus, the force-dampening arrangement should preferably be arranged closer to the sea floor than to the surface when the string element is in a position or situation to be hung off in the well. In such a position or situation, the interconnectable parts are normally near the subsea well head.

EXAMPLE OF EMBODIMENT

In the following, a non-limiting detailed example of embodiment is presented in order to illuminate and explain the features and advantages of the present invention. The example is presented with reference to the drawings, in which FIG. 1 shows a schematic principle view of a floating drilling rig in the process of reconnecting to a hang-off tool, the hang-off tool suspending a drill pipe extending into the subsea well;

Figure 1:
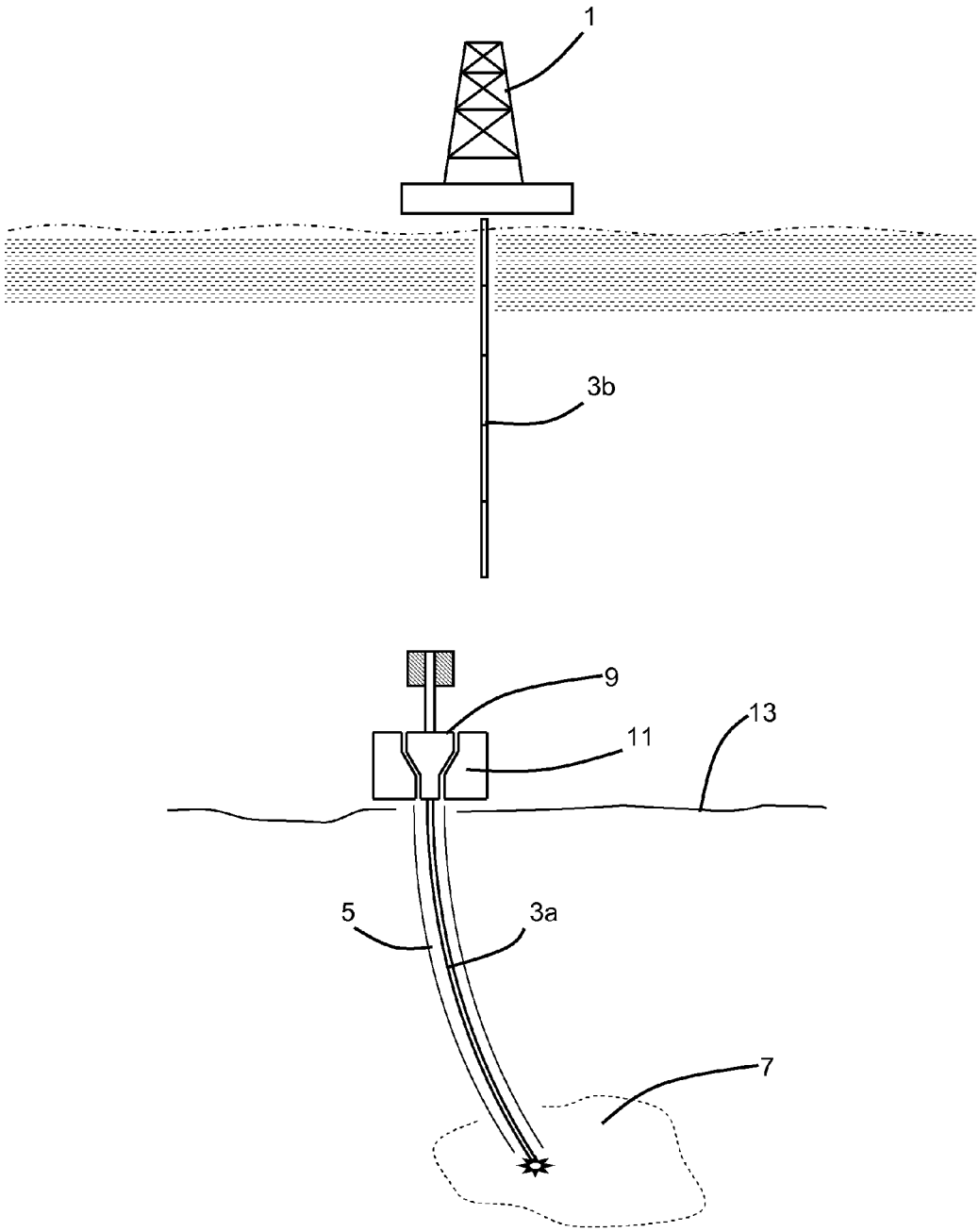

FIG. 1 illustrates a drilling rig 1 in the process of reconnecting to a drill pipe 3*a* left in the subsea well 5. The drilling rig 1 may have been disconnected from the drill pipe 3*a* due to bad weather. The drill pipe 3*b* extending down from the drilling rig 1 is thus disconnected from the drill pipe section 3*a*. The drill pipe 3*a* in the subsea well can extend several thousands of meters into the seabed, such as to a reservoir 7. When disconnected from the rig 1, the drill pipe 3*a* is hung off with a hang-off tool 9 arranged in the wellhead 11 at the sea floor 13. It should be underlined that FIG. 1 is only a principle sketch in order to picture a likely situation for using the force-dampening arrangement according to the present invention.

Figure 2:
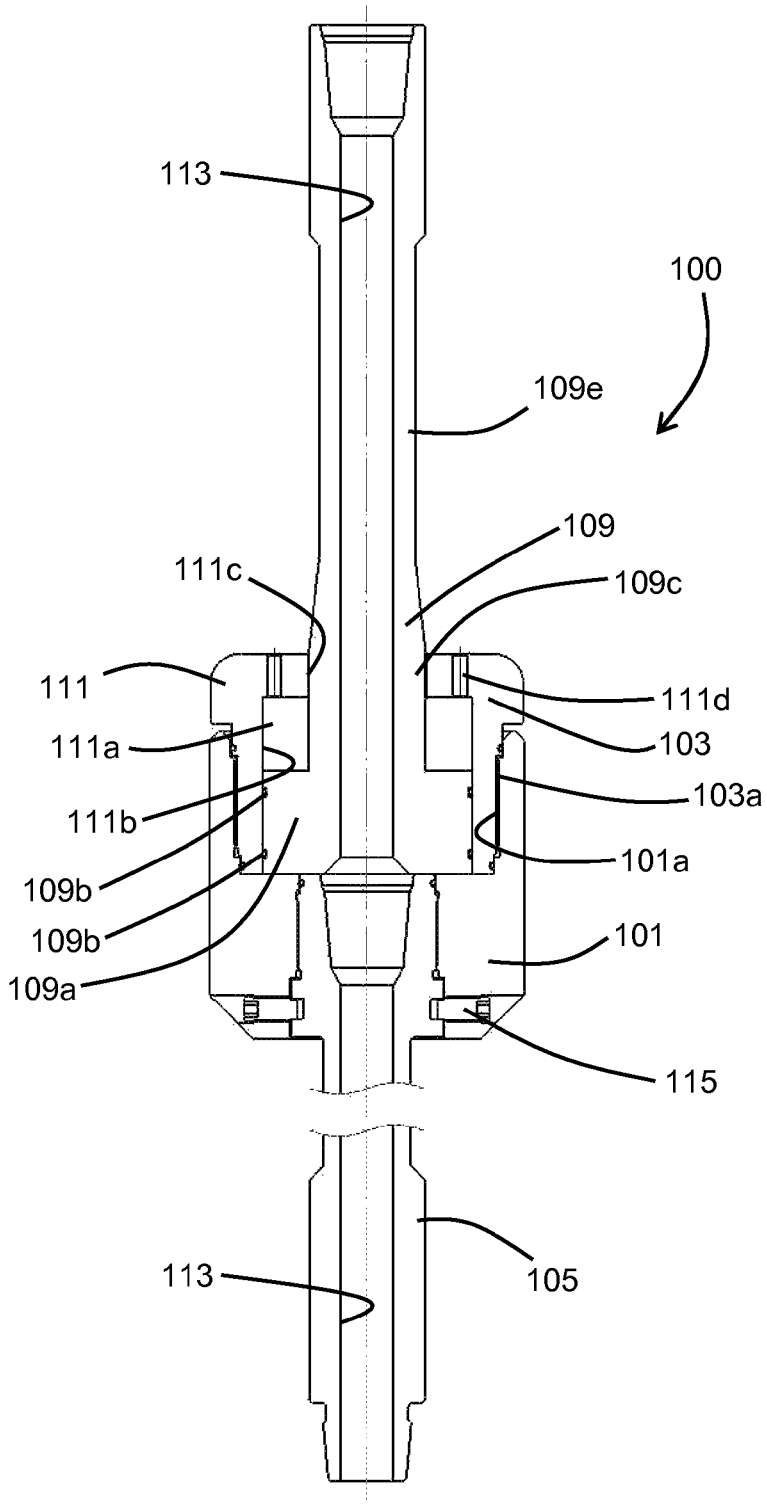
FIG. 2 shows a cross section of two releasable interconnectable parts in a connected position, as well as a force-dampening arrangement according to the invention.

FIG. 2 shows a cross section of a force-dampening arrangement 100 according to an embodiment of the present invention. In this embodiment, two releasable interconnectable parts 101, 103 are shown in a connected position. The lower interconnectable part 101 exhibits inwardly facing threads 101*a*, whereas the upper interconnectable part 103 correspondingly has outwardly facing threads 103*a*. Thus, the lower and upper parts 101, 103 can be connected and disconnected by mutual rotation between them. The lower part 101 is adapted to be connected to a string of drill pipe 3*a* (FIG. 1) extending into a subsea well 5, through a pipe section 105. Correspondingly, the second part 103 is adapted to be connected to a drill pipe 3*b* through a pipe section 109*e*.

The force-dampening arrangement 100 comprises an upper and lower section 109, 111 that are axially movable with respect to each other. The lower section 111 exhibits a compartment 111*a* within which a part of the upper section 109 is arranged. This part is shaped as a piston component 109*a* that can reciprocate axially within the compartment 111*a*. To the radially outer face of the piston component 109*a* there is attached two seals 109*b* that seal against the inwardly facing surface of the compartment 111*a*. The upper section 109 extends into the compartment 111*a* with a square-shaped through part 109*c*, through a correspondingly shaped through hole 111*c* in the upper part of the lower section 111. Thus, a rotation of the upper section 109 will result in a corresponding rotation of the lower section 111.

The connection and disconnection between the threaded parts of the lower and upper interconnecting parts 101, 103 can be provided by the appropriate rotation of the upper section 109 with respect to the lower section 111.

It should be noticed that in this embodiment, the lower section 111 of the force-dampening arrangement 100 is the same component as the upper interconnectable part 103 referred to above.

In the upper part of the lower section 111 there are arranged a plurality of through channels 111*d* that provide fluid connection between the compartment 111*a*, above the piston component 109*a*, and the surrounding sea water. The primary function of the through channels 111*d* is to vent the compartment above the piston component 109*a* to avoid hydrostatic locking of the piston component 109*a*. The secondary function is to dampen the axial movement between the upper and lower section 109, 111. The latter function is accomplished by appropriately dimensioning of the through channels 111*d*. Small cross sections and few channels will slow down the respective axial movements between the upper and lower sections 109, 111. Larger cross sections and many channels will on the other hand result in less braking of the movement.

As already discussed in the general part this description, when connecting or disconnecting the two interconnecting parts, the upper part may move up and down with respect to the lower part due to heave movements of the floating surface installation from which it is suspended. Due to the weight of suspension elements, such as the drill pipe 3*b* (FIG. 1), these movements may cause significant impact forces between said parts. Referring to FIG. 2, one will appreciate that the lower section 111 will be axially or vertically movable with respect to the upper section 109 before (and after) aligning and connecting the interconnectable parts 101, 103 with each other. Thus, during the initial phase of screwing the upper interconnectable part 103 to the lower interconnectable part 101, this feature will protect the outermost threads and surfaces from damage. When disconnecting the interconnectable parts 101, 103 by unscrewing the threads 101*a*, 103*a*, the threads are protected from damage in corresponding manner if a downward heave movement of the upper section 109 takes place just before or just after unscrewing has finished.

It is noticed that a through bore 113 runs axially through the entire arrangement shown in FIG. 2, from the pipe section 109*e* above to the pipe section 105 below, through the interconnectable parts and through the upper and lower sections 109, 111. Thus, in a connected mode, the fluid connection is maintained through the force-dampening arrangement 100.

Figure 4:
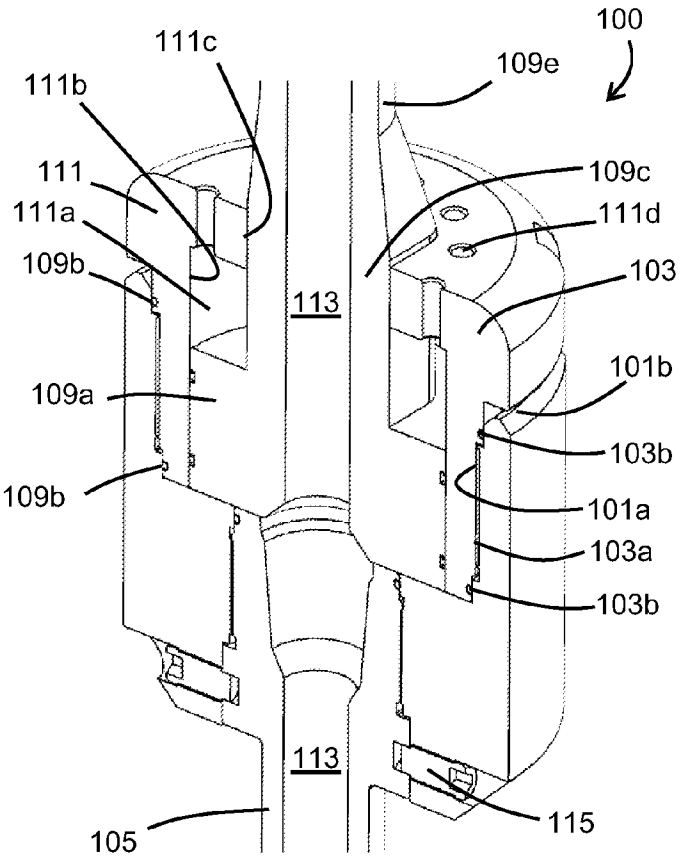
FIG. 4 shows a perspective cross section view of the connection arrangement in FIG. 3.
Figure 3:
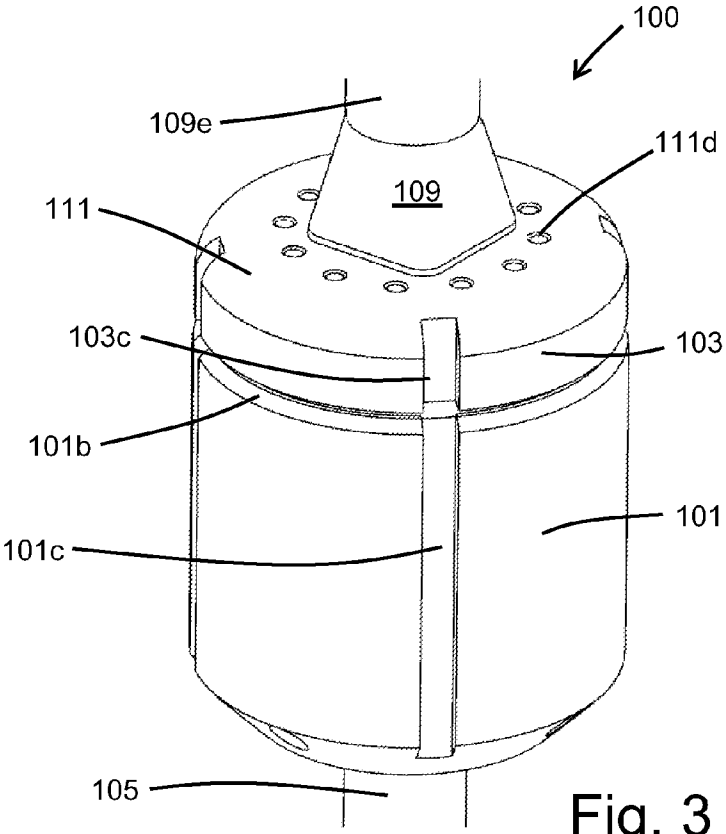
FIG. 3 shows a perspective section view of the connection arrangement in FIG. 2.

FIGS. 3 and 4 show a perspective view and a cross section perspective view, respectively, of the force-dampening arrangement 100 in FIG. 2. Referring first to FIG. 3, four slots 101*c* are arranged peripherally about the circumference of the lower interconnectable part 101. Correspondingly, the upper interconnectable part 103 has slots 103*c*. The slots 101*c*, 103*c* provide fluid paths between the interconnectable parts 101, 103 and the inner surface of a marine riser (not shown). This facilitates the vertical movement within the marine riser, as fluid in the riser can flow freely past the interconnectable parts 101, 103. In case the slots 101*c* in the lower interconnectable part 101 are not aligned with the corresponding slots 103*c* in the upper interconnectable part 103, a circumferentially arranged slot 101*b* provides fluid connection between the misaligned slots 101*c* and 103*c*.

Referring to FIG. 4, the upper interconnecting part 103 exhibits two seals 103*b* that seal against the lower interconnecting part 101 in the connected mode. One seal 103*b* is arranged on each side (above and below) of the threads 103*a*. Together with the seals 109*b*, the seals 103*b* seal the fluid in the bore 113 and chamber 111*a* (below the piston component 109*a*) apart from the surrounding sea water, and vice versa, when in the connected mode.

As can be seen both in FIG. 2 and in FIG. 4, the pipe section 105 is attached to the lower interconnectable part 101 by means of a plurality of threaded bolts 115.

Figure 5:
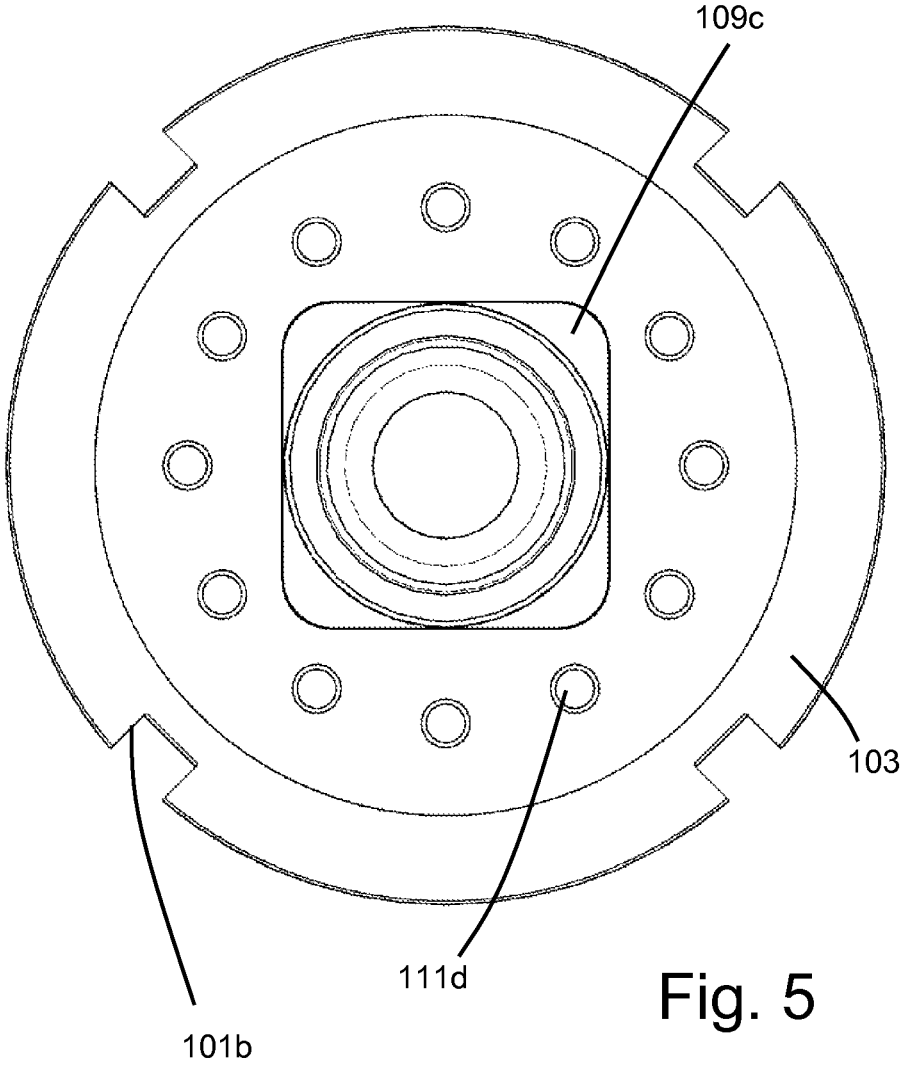
FIG. 5 shows a part cross section view seen in the axial direction of the connection arrangement.

FIG. 5 is a cross section view of the upper interconnectable part 103, which in this embodiment is the same component as the lower section 111. This view illustrates particularly the square-shaped form of the through-hole 111*c* and through-part 109*c*, rendering the transmission of rotational forces possible.

According to the invention, the upper and lower interconnectable parts do not have to be part of the arrangement as shown in the embodiment described with reference to FIGS. 1-5. Instead, the interconnectable parts can be either below or above the force-dampening arrangement according to the invention. However, in order to fulfil the main purpose of the invention in a favourable manner, the force-dampening arrangement should preferably be arranged in such a position above the interconnectable parts that little weight is arranged between the interconnectable parts and the force-dampening arrangement. Such weight can result in the above-described unwanted forces between the interconnectable parts just before interconnection or just after decoupling of the interconnectable parts due to the vertical heave movements of that weight.

If the force-dampening arrangement is arranged below the interconnectable parts, on the other hand, it should preferably be arranged close to the interconnectable parts. In that way, any weight between the force-dampening arrangement and the interconnectable parts is minimized, thereby reducing its inertia and thus any forces resulting from colliding the two interconnectable parts. When the force-dampening arrangement is arranged below the interconnectable parts, the force-dampening arrangement can be provided with a spring bias means in order to bias the upper section in an upper position, thereby making the upper section ready to be forced downwards in case of a collision between the interconnectable parts.

Figure 6:
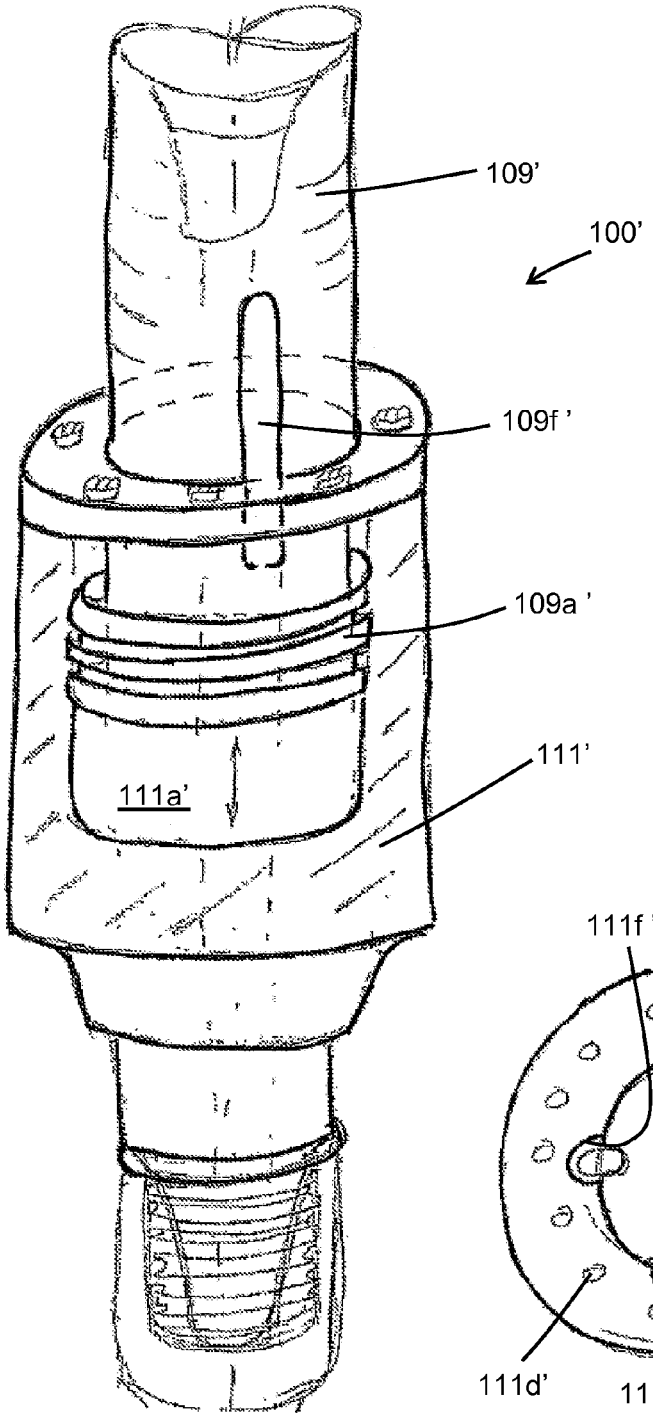
FIG. 6 shows an alternative embodiment of a force-dampening arrangement according to the invention.
Figure 7:
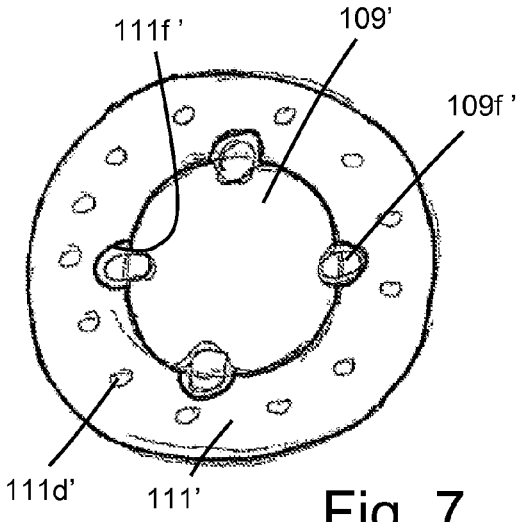
FIG. 7 shows a cross section view of the arrangement in FIG. 6.

FIGS. 6 and 7 show a vertical view and a cross section view, respectively, of an alternative embodiment of the force-dampening arrangement 100' according to the invention. Here, no interconnectable parts are shown. The upper part of the upper section 109' and the lower part of the lower section 111' have threaded connection interfaces for connection with a drill pipe joint. Thus, the force-dampening arrangement 100' is arranged to be inserted in a pipe string, between pipe string lengths.

Furthermore, in this embodiment, the means for providing transmission of rotational forces between the upper and lower section, 109', 111' is a plurality of axially extending sliding lists 109*f'* that extend into facing slots 111*f'* in the upper part of the lower section 111'.

Regardless of where the force-dampening arrangement 100, 100' is arranged with respect to the interconnectable parts 101, 103, it can be provided with a spring bias means (not shown) in order to bias the upper and lower sections 109, 109', 111, 111' in the axially extended position. In this way, the force-dampening arrangement 100, 100' will at any time, provided it is not axially compressed, be in a mode where it is ready to yield for vertical collision forces.

Preferably, the force-dampening arrangement is arranged within 30 meters of interface between the interconnectable parts. Even more preferable, it is arranged within 10 or even 5 meters of the interface between the interconnectable parts. However, in the most preferred embodiment, one of the interconnectable parts is the same component as one of the sections of the force-dampening arrangement.

The invention claimed is:

1. A tube string assembly extending into a subsea well through a wellhead at a sea floor, said tube string assembly comprising:

a lower interconnectable part connected to an upper end of a string element extending into the subsea well through the wellhead at the sea floor;

an upper interconnectable part suspended from a floating surface installation from a suspension pipe, the string element and the suspension pipe being components of the tube string assembly, in a connected mode the lower interconnectable part is connected to the upper interconnectable part at a subsurface position and in a disconnected mode the upper and lower interconnectable parts are disconnected at the subsurface position;

a hang-off tool connected to the string element, when in the disconnected mode the string element is suspended in the subsea well by the hang-off tool arranged in the wellhead;

a force-dampening arrangement connected to the tube string assembly above the string element and below the floating surface installation in a position closer to the sea floor than to the floating surface installation when the string element is in a position or situation to be hung off in the subsea well from the hang-off tool;

the force dampening arrangement exhibits a first section and a second section that are vertically movable in relation to each other both in the connected mode and in the disconnected mode, thereby yielding for impact forces between the upper and lower interconnectable parts during connection or disconnection of the string element and the suspension pipe at a subsea position resulting from vertical heave movement of the suspension pipe moving vertically with respect to the string element; and wherein when in the connected mode, the tube string assembly is adapted to be lifted upwards towards the floating surface installation.

2. The tube string assembly according to claim 1, wherein the first and second sections of the force dampening arrangement are rotationally interconnected in such a manner that rotation of one of the first and the second section will instantly or eventually result in rotation of or rotational forces exerted onto the other of the first and the second sections.

3. The tube string assembly according to claim 1, wherein the suspension pipe comprises a drill string.

4. The tube string assembly according to claim 1, wherein said upper and lower interconnectable parts exhibit a threaded connection.

5. The tube string assembly according to claim 1, wherein the first section exhibits a compartment within which a portion of the second section can reciprocate in a vertical direction.

6. The tube string assembly according to claim 5, wherein the second section extends into the compartment with a non-concentric through part running through a non-concentric opening in the first section, wherein engagement of the non-concentric through part with the non-concentric opening is a rotational coupling that results in rotational forces onto the other of the first and the second section.

7. The tube string assembly according to claim 5, wherein the second section exhibits a piston component arranged in the compartment, wherein the compartment is shaped as a piston cylinder, and a seal is arranged to seal between said piston cylinder and the piston component.

8. The tube string assembly according claim 7, wherein the force-dampening arrangement comprises at least one vent for inflow or outflow of surrounding water into or out of the compartment, the at least one vent functions as a damper for the relative movements between the first and second sections.

9. The tube string assembly according to claim 1, wherein one of the upper and the lower interconnectable parts is integrated with one of the first and the second sections.

10. The tube string assembly according to claim 1, wherein the force-dampening arrangement is arranged below an interface of said interconnectable parts.

11. The tube string assembly according to claim 1, wherein the force-dampening arrangement is arranged above an interface of said interconnectable parts.

12. The tube string assembly according to claim 1, wherein the force-dampening arrangement is arranged within 30 meters from an interface of said interconnectable parts.

13. The tube string assembly according to claim 1, wherein the force-dampening arrangement further comprises a spring functionally arranged between the first and second sections to dampen a mutual vertical movement.

14. The tube string assembly according to claim 1, wherein:

the force-dampening arrangement exhibits a fluid connection which provides fluid connection between two pipes arranged at each end of the force-dampening arrangement; and a pipe of the two pipes is the suspension pipe suspended from the floating surface installation.

15. A method for connecting a suspension element extending from a floating surface installation at a subsea location to a string element extending into a subsea well, the method comprising:

lowering the suspension element from the floating surface installation to the string element, wherein the string element is suspended in a subsea well from a hang-off tool arranged in a wellhead at a seafloor;

connecting at the subsea location a lower interconnectable part of the suspension element to an upper interconnectable part of the string element to form a connected junction;

raising the connected junction towards the floating surface installation to facilitate removal of the hang-off tool; and dampening impact forces, via a force-dampening arrangement, between the lower interconnectable part and the upper interconnectable part during the connecting and the removal of the hang-off tool.

16. The method of claim 15, wherein the dampening comprises utilizing the force-dampening arrangement comprising a first section vertically moveable relative to a second section.

17. The method of claim 15, wherein the dampening comprises utilizing the force-dampening arrangement comprising a first section vertically moveable relative to a second section, wherein the first section comprises a piston component vertically moveable within a compartment of the second section.

18. The method of claim 17, wherein the dampening comprises venting a chamber to surrounding seawater.

19. The method of claim 16, wherein the force dampening arrangement is positioned within 30 meters of an interface of between the lower and the upper interconnectable parts.

* * * * *

UNITED STATES PATENT AND TRADEMARK OFFICE

CERTIFICATE OF CORRECTION

PATENT NO. : 8,931,563 B2
APPLICATION NO. : 13/142891
DATED : January 13, 2015
INVENTOR(S) : Ole Jørgen Holtet et al.

It is certified that error appears in the above-identified patent and that said Letters Patent is hereby corrected as shown below:

In the Claims:

| Patent | Application File |
|---|---|
| Column 7, Line 53, Claim 8 | Replace "as a damper for the relative movements" with -- as a damper for relative movements -- |

Signed and Sealed this
Twelfth Day of May, 2015

Michelle K. Lee

Michelle K. Lee
*Director of the United States Patent and Trademark Office*